US010840035B1

(12) United States Patent
Strebel Marzano et al.

(10) Patent No.: US 10,840,035 B1
(45) Date of Patent: Nov. 17, 2020

(54) ARC CHAMBER VENTING

(71) Applicant: ROCKWELL AUTOMATION SWITZERLAND GMBH, Aarau (CH)

(72) Inventors: Thomas Strebel Marzano, Birmenstorf (CH); Beat Villiger, Aarau (CH); Sandro Liberto, Aarau (CH)

(73) Assignee: Rockwell Automation Switzerland GmbH, Aarau (CH)

( * ) Notice: Subject to any disclaimer, the term of this patent is extended or adjusted under 35 U.S.C. 154(b) by 0 days.

(21) Appl. No.: 16/555,406

(22) Filed: Aug. 29, 2019

(51) Int. Cl.

| | |
|---|---|
| ***H01H 9/34*** | (2006.01) |
| ***H01H 9/30*** | (2006.01) |
| ***H01H 9/36*** | (2006.01) |
| ***H01H 33/08*** | (2006.01) |
| ***H01H 33/18*** | (2006.01) |
| ***H01H 33/72*** | (2006.01) |

(52) U.S. Cl.
CPC ..... *H01H 9/342* (2013.01); *H01H 9/302* (2013.01); *H01H 9/362* (2013.01); *H01H 33/08* (2013.01); *H01H 33/18* (2013.01); *H01H 33/72* (2013.01); *H01H 2009/367* (2013.01); *H01H 2205/002* (2013.01)

(58) Field of Classification Search
CPC ..... H01H 9/342; H01H 9/308; H01H 9/362; H01H 9/345; H01H 9/346; H01H 33/08; H01H 33/18; H01H 33/72; H01H 2009/367; H01H 2205/002
USPC ..... 218/157, 155, 156, 149; 335/201, 202
See application file for complete search history.

(56) References Cited

U.S. PATENT DOCUMENTS

| | | | | |
|---|---|---|---|---|
| 5,072,081 | A * | 12/1991 | Sepelak | H01H 1/365 218/151 |
| 5,635,886 | A * | 6/1997 | Pichard | H01H 73/045 335/132 |
| 6,288,354 | B1 * | 9/2001 | Niebler | H01H 9/362 218/149 |
| 7,186,941 | B2 * | 3/2007 | Yeon | H01H 9/302 218/149 |
| 7,285,742 | B2 * | 10/2007 | Kinzler | H01H 71/0207 218/34 |
| 9,324,519 | B2 * | 4/2016 | Karlen | H01H 9/362 |
| 10,056,210 | B2 * | 8/2018 | Marzano | H01H 9/362 |
| 10,224,162 | B2 * | 3/2019 | Graefenhahn | H01H 9/362 |

* cited by examiner

*Primary Examiner* — William A Bolton
(74) *Attorney, Agent, or Firm* — Quarles & Brady LLP

(57) ABSTRACT

A circuit interrupting device is provided. In some configurations, the circuit interrupting device includes a base and an arc chamber assembly received within the base. The arc chamber assembly includes an arc chamber framework and a plurality of splitter plates received within the arc chamber framework. The arc chamber framework includes a first plurality of protrusions and a second plurality of protrusions that laterally extend in a direction toward one another. Adjacent pairs of the first plurality of protrusions and the second plurality of protrusions are arranged on opposing sides of each of the plurality of splitter plates.

19 Claims, 11 Drawing Sheets

ARC CHAMBER VENTING

CROSS-REFERENCES TO RELATED APPLICATIONS

Not Applicable.

STATEMENT REGARDING FEDERALLY SPONSORED RESEARCH

Not Applicable.

BACKGROUND

Generally, circuit interrupters interrupt a current carrying path between a source of electrical power and a load. Conventional circuit interrupting devices may take the form of circuit breakers, contactors, relays, motor starters and the like.

BRIEF SUMMARY

The present disclosure relates generally to circuit interrupting devices and, more particularly, to a technique for quenching an arc and preventing reignition of an arc that results from interruption of a current carrying path between a source of electrical power and a load.

In one aspect, the present disclosure provides a circuit interrupting device that includes a base and an arc chamber assembly received within the base. The arc chamber assembly includes an arc chamber framework and a plurality of splitter plates received within the arc chamber framework. The arc chamber framework includes a first plurality of protrusions and a second plurality of protrusions that laterally extend in a direction toward one another. Adjacent pairs of the first plurality of protrusions and the second plurality of protrusions are arranged on opposing sides of each of the plurality of splitter plates.

In one aspect, the present disclosure provides a circuit interrupting device that includes a base, a rib, and an arc chamber assembly. The base includes an open end and defines an internal cavity with an inner surface. The rib extends from the inner surface in a direction toward the open end and includes a pair of opposing rib arms. The arc chamber assembly is received within the internal cavity and includes a first panel, a second panel, and a plurality of splitter plates received within first panel and the second panel. The first panel includes a first plurality of protrusions extending laterally toward the second panel, and the second panel includes a second plurality of protrusions extending laterally toward the first panel. The first plurality of protrusions are offset from the second plurality of protrusions to form two flow paths that extend along the plurality of splitter plates and around the pair of opposing rib arms.

In one aspect, the present disclosure provides a circuit interrupting device that includes a base, a rib integrally formed with the base, and an arc chamber assembly received within the base. The arc chamber assembly includes an arc chamber framework defining a plurality of insert slots each receiving a splitter plate therein and a plurality of protrusions extending in laterally opposing directions and offset from one another. The rib is at least partially received within a notch formed between the plurality of protrusions such that flow paths are formed on opposing sides of the rib.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

Figure 1:
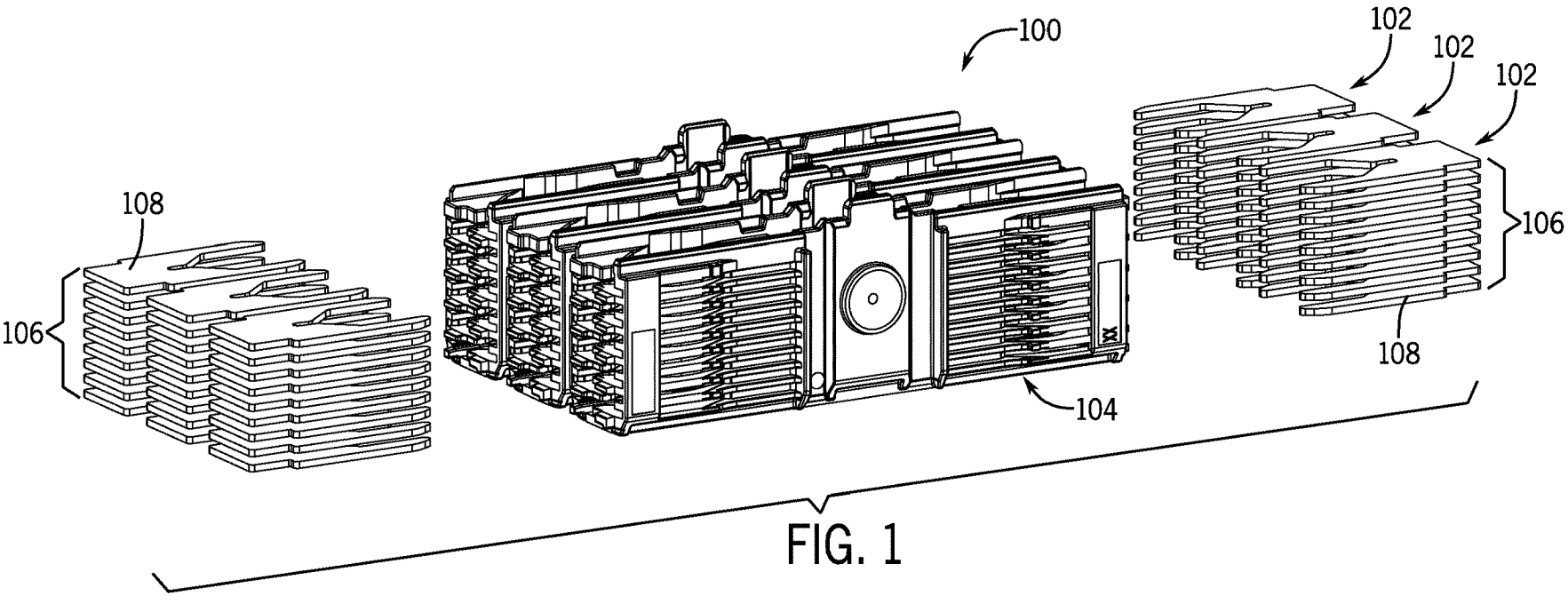
FIG. 1 is an exploded view of an arc chamber assembly including splitter plates, according to aspects of the present disclosure.

Before any aspect of the present disclosure are explained in detail, it is to be understood that the present disclosure is not limited in its application to the details of construction and the arrangement of components set forth in the following description or illustrated in the following drawings. The present disclosure is capable of other configurations and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported,"

and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use aspects of the present disclosure. Various modifications to the illustrated configurations will be readily apparent to those skilled in the art, and the generic principles herein can be applied to other configurations and applications without departing from aspects of the present disclosure. Thus, aspects of the present disclosure are not intended to be limited to configurations shown, but are to be accorded the widest scope consistent with the principles and features disclosed herein. The following detailed description is to be read with reference to the figures, in which like elements in different figures have like reference numerals. The figures, which are not necessarily to scale, depict selected configurations and are not intended to limit the scope of the present disclosure. Skilled artisans will recognize the non-limiting examples provided herein have many useful alternatives and fall within the scope of the present disclosure.

The use of the terms "downstream" and "upstream" herein are terms that indicate direction relative to a flow (e.g., of a fluid, gas, plasma, or any other matter). The term "downstream" corresponds to the direction of flow, while the term "upstream" refers to the direction opposite or against the direction of flow.

Conventional circuit interrupters may attempt to quench of an arc that is generated in response to a movable contact being actuated in response to an event (e.g., turning off the circuit interrupter, de-energizing a coil voltage of a relay or contactor, or fault conditions). In some non-limiting examples, the generated arc may be quenched by separating the arc, via ferromagnetic plates arranged adjacent to a location of the initiation of the generated arc, into smaller arcs. While these configurations may be sufficient to quench the initial generation of the arc, in some applications, the arc exhaust may undesirably reignite the arc.

Generally, the present disclosure provides systems and methods for a circuit interrupter device that may quench a generated arc and may inhibit or substantially prevent the arc exhaust from reigniting. In some non-limiting examples, the circuit interrupter device may include a base and an arc chamber assembly that cooperate to separate the generated arc and redirect the arc as is travels through the arc chamber and the base. In this way, for example, the generated arc may be quenched and the quenched arc exhaust may be inhibited or substantially prevented from reigniting as it travels through and out of the base.

In some non-limiting examples, the arc chamber may include one or more protrusions that redirect and at least partially separate the arc to discourage reignition after quenching of the arc. For example, the one or more protrusions may extend laterally toward one another in alternating fashion. That is, one of the protrusions may extend laterally toward one side of the arc chamber to redirect the arc in a first direction and an adjacent protrusion may extend laterally toward another side of the base to redirect the arc in a second direction.

In some non-limiting examples, the base may include a rib arranged adjacent to or downstream of the one or more protrusions formed in the arc chamber. In general, the rib may elongate a distance that the arc exhaust needs to travel before being allowed to fully mix and exit the base. The rib may also maintain the separation and redirection provided by the one or more protrusions, which further inhibits or substantially prevents reignition of the arc exhaust.

FIG. 1 illustrates one non-limiting example of an arc chamber assembly 100 according to the present disclosure. In some non-limiting examples, the arc chamber assembly 100 may be installed within a circuit interruption device (e.g., a circuit breaker) that may be configured to control electrical current carrying paths for three phases of electrical power. In the illustrated non-limiting example, the arc chamber assembly 100 includes three arc chamber sections 102 (e.g., one for each of the three phases). In some non-limiting examples, the arc chamber assembly 100 may include more or less than three sections 102 for a given application.

Each of the arc chamber sections 102 may be designed similarly and include like components. In the illustrated non-limiting example, each of the arc chamber sections 102 may include an arc chamber framework 104 and a pair of splitter plate groups 106 arranged on opposing longitudinal ends of the corresponding arc chamber framework 104. Each of the splitter plate groups 106 may include a plurality of splitter plates 108.

Figure 2:
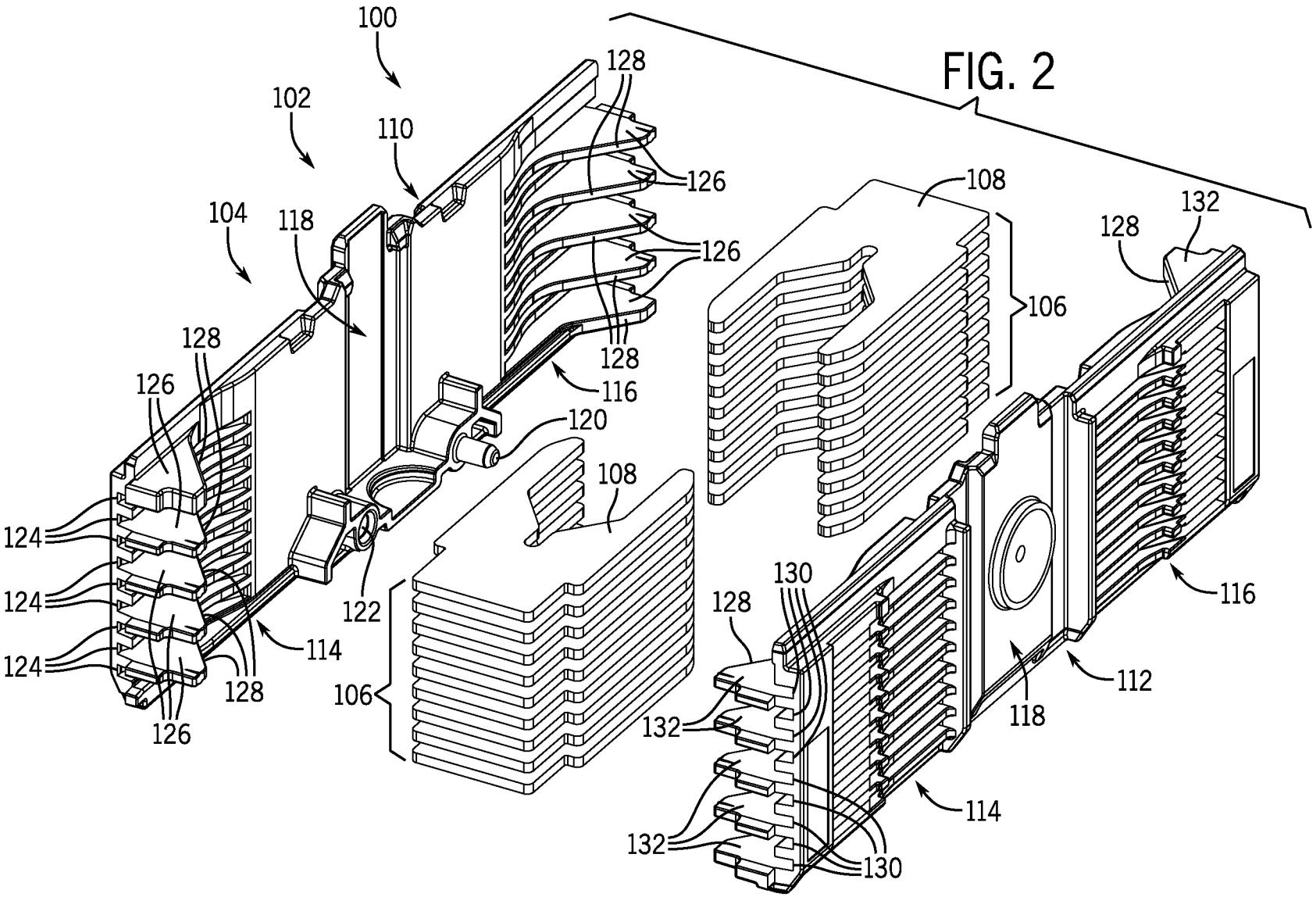
FIG. 2 is an exploded perspective view of an arc chamber section of the arc chamber assembly of FIG. 1.
Figure 3:
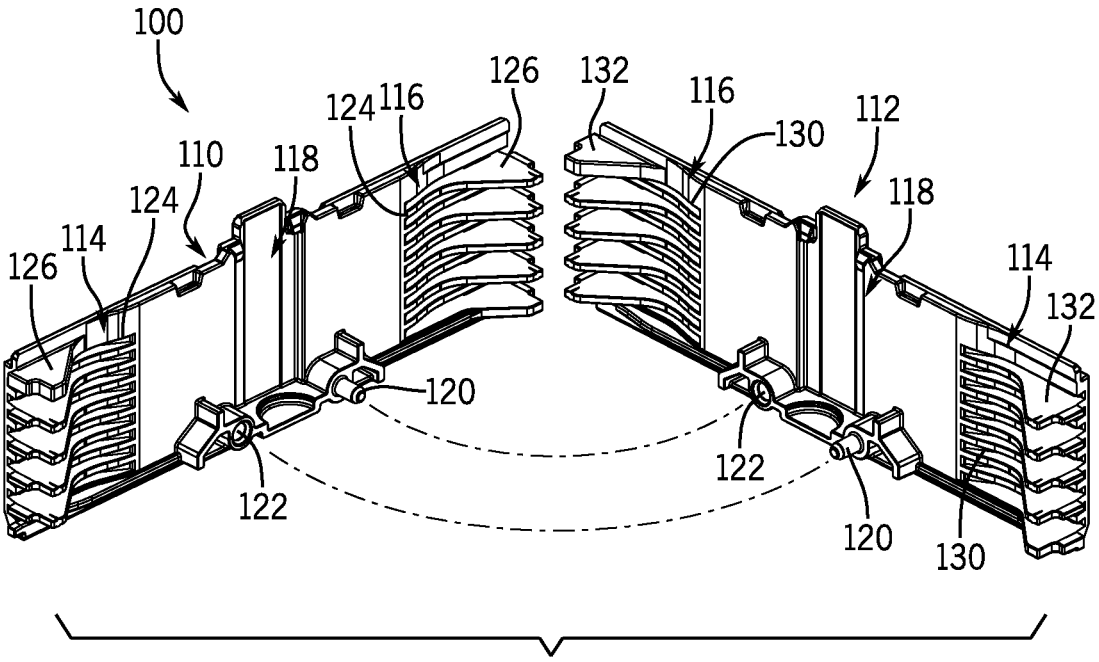
FIG. 3 is an assembly view of an arc chamber framework of the arc chamber section of FIG. 2.

With reference to FIGS. 1-3, each of the arc chamber frameworks 104 may include a first panel 110 and a second panel 112 that may be coupled to one another. In some non-limiting examples, the first panel 110 and the second panel 112 may be molded of a resin comprised of gas evolving materials, such that the heat of an arc causes the material to emit a gas with arc quenching properties, in addition to raising the pressure in the arc chamber assembly both of which have a positive effect on extinguishing of the arc. In the illustrated non-limiting example, each of the first panel 110 and the second panel 112 may include a first splitter plate portion 114, a second splitter plate portion 116, and a center portion 118 arranged between the first splitter plate portion 114 an the second splitter plate portion 116. The first splitter plate portion 114 and the second splitter plate portion 116 may be arranged on longitudinally opposing ends of the first panel 110 and the second panel 112.

Figure 4:
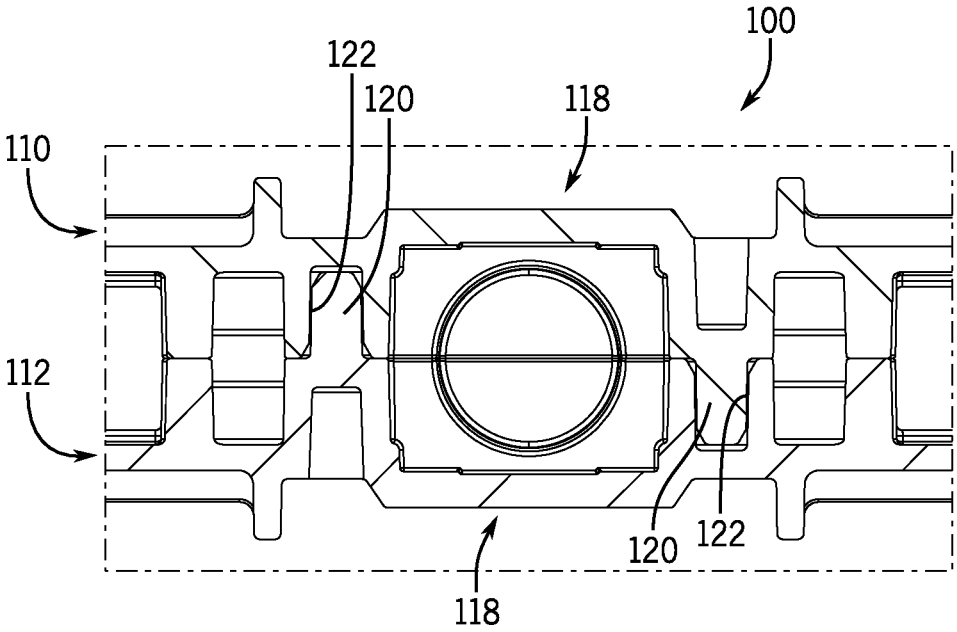
FIG. 4 is partial top plan view of the arc chamber framework of FIG. 3 with the arc chamber framework assembled.

In general, the first panel 110 and the second panel 112 may be coupled to one another, for example, via an integrally molded components that connect to one another. In the illustrated non-limiting example, each of the first panel 110 and the second panel 112 may include a pin 120 and a recess 122. The pin 120 may be longitudinally separated from the recess 122 and may protrude laterally outward from a bottom end of the center portion 118. The recess 122 may define an aperture that is recessed laterally inward into the bottom end of the center portion 118. To assemble the first panel 110 to the second panel 112, the pin 120 of the first panel 110 may be aligned with the recess 122 of the second panel 112 and the pin 120 of the second panel 112 may be aligned with the recess 122 of the first panel 110. The first panel 110 and the second panel 112 may then be pushed together so that the pins 120 are received within the recesses 122, thereby securing the first panel 110 and the second panel 112 together (see, e.g., FIG. 4).

Each of the first splitter plate portion 114 and the second splitter plate portion 116 of the first panel 110 may include a first plurality of slots 124 and a first plurality of protrusions 126. The first plurality of slots 124 and the first plurality of protrusions 126 may be spaced vertically (e.g., from the perspective of FIGS. 1-3) along the first splitter plate portion 114 and the second splitter plate portion 116 of the first panel 110. Each of the first plurality of slots 124 may be recessed laterally into the first splitter plate portion 114 and the second splitter plate portion 116 of the first panel 110 and extend longitudinally along a portion thereof.

In the illustrated non-limiting example, the first plurality of protrusions 126 may extend laterally outward from the first splitter plate portion 114 and the second splitter plate portion 116 of the first panel 110. The first plurality of protrusions 126 may each define a generally triangular shape that includes an angled surface 128. The angled surfaces 128 of each of the first plurality of protrusions 126 may taper laterally outward as they extend longitudinally in a direction toward the longitudinal ends of the first panel 110. That is, each of the first plurality of protrusions 126 may define a general increase in laterally outward extension as it extends in a direction toward the respective lateral end of the first panel 110. The angled surfaces 128 of the first plurality of protrusions 126 are arranged internally between the first panel 110 and the second panel 112 (see, e.g., FIGS. 6, 9, and 12). The angled surfaces 128 of the first plurality of protrusions 126 angle toward the second panel 112 (see, e.g., FIGS. 6, 9, and 12).

Similar to the first panel 110, the second panel 112 may include a second plurality of slots 130 and a second plurality of protrusions 132. The angled surfaces 128 of the second plurality of protrusions 132 are arranged internally between the first panel 110 and the second panel 112 (see, e.g., FIGS. 6, 9, and 12). The angled surfaces 128 of the second plurality of protrusions 132 angle toward the first panel 110 (see, e.g., FIGS. 6, 9, and 12). The second plurality of slots 130 and the second plurality of protrusions 132 formed in the second panel 112 may be similar in design and functionality as the first plurality of slots 124 and the first plurality of protrusions 126 formed in the first panel 110. As such, the foregoing description of the first plurality of slots 124 and the first plurality of protrusions 126 formed in the first panel 110 also applies to the second plurality of slots 130 and the second plurality of protrusions 132 formed in the second panel 112. As will be described herein, the arrangement of the first plurality of protrusions 126 on the first panel 110 may be different than the second plurality of protrusions 132 on the second panel 112. For example, the arrangement of the first plurality of protrusions 126 on the first panel 110 may be staggered or offset from the second plurality of protrusions 132 on the second panel 112.

Figure 5:
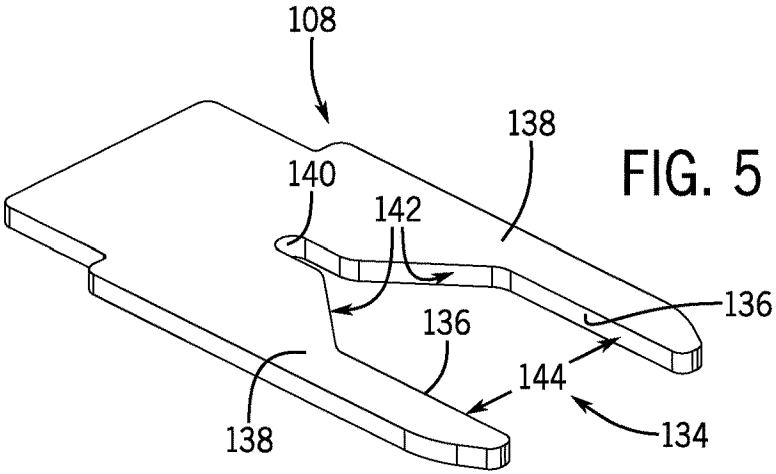
FIG. 5 is a is perspective view of a splitter plate of the arc chamber section of FIG. 2.

With reference to FIG. 5, the splitter plates 108 may define a generally planar structure and may be fabricated from a ferromagnetic material. In general, each of the splitter plates 108 may be sized to be slideably received within an aligned pair of the first plurality of slots 124 of the first panel 110 and the second plurality of slots 130 of the second panel 112. Typically, the number of splitter plates 108 in a splitter plate group 106 may vary depending upon the electrical parameters of the circuit interrupting device on which the arc chamber assembly 100 is installed.

In the illustrated non-limiting example, the splitter plate 108 may include a generally V-shaped recess 134 that defines a generally decreasing lateral width as it extend into the splitter plate 108. The recess 134 may be defined between internal edges 136 of opposing splitter plate arms 138, and may include a notch 140, a tapered portion 142, and a straight portion 144. The tapered portion 142 may be arranged between the notch 140 and the straight portion 144. In the illustrated non-limiting example, the notch 140 may be arranged at one end of the recess 134 and may define a decreased lateral width when compared to the tapered portion 142 and the straight portion 144. The tapered portion 142 may extend from a junction between the notch 140 and the tapered portion 142 to a junction between the tapered portion 142 and the straight portion 144. As the tapered portion 142 extends from the notch 140 to the straight portion 144, the tapered portion 142 may increase in lateral width. The straight portion 144 may define a generally constant lateral width, and may extend from the junction between the tapered portion 142 and the straight portion 144 to an end of the splitter plate 108.

In general, the general shape of the recess 134 including its contour and overall width and depth may be configured to increase the amount of magnetic material in proximity to power and load contacts (see, e.g., FIGS. 13 and 14), which maximizes the attractive forces on a generated arc that occurs within the arc chamber assembly 100 for most effective quenching. In some non-limiting examples, the shape and contour defined by the recess 134 may be varied to accommodate different structures within a given circuit interrupting device.

Figure 6:
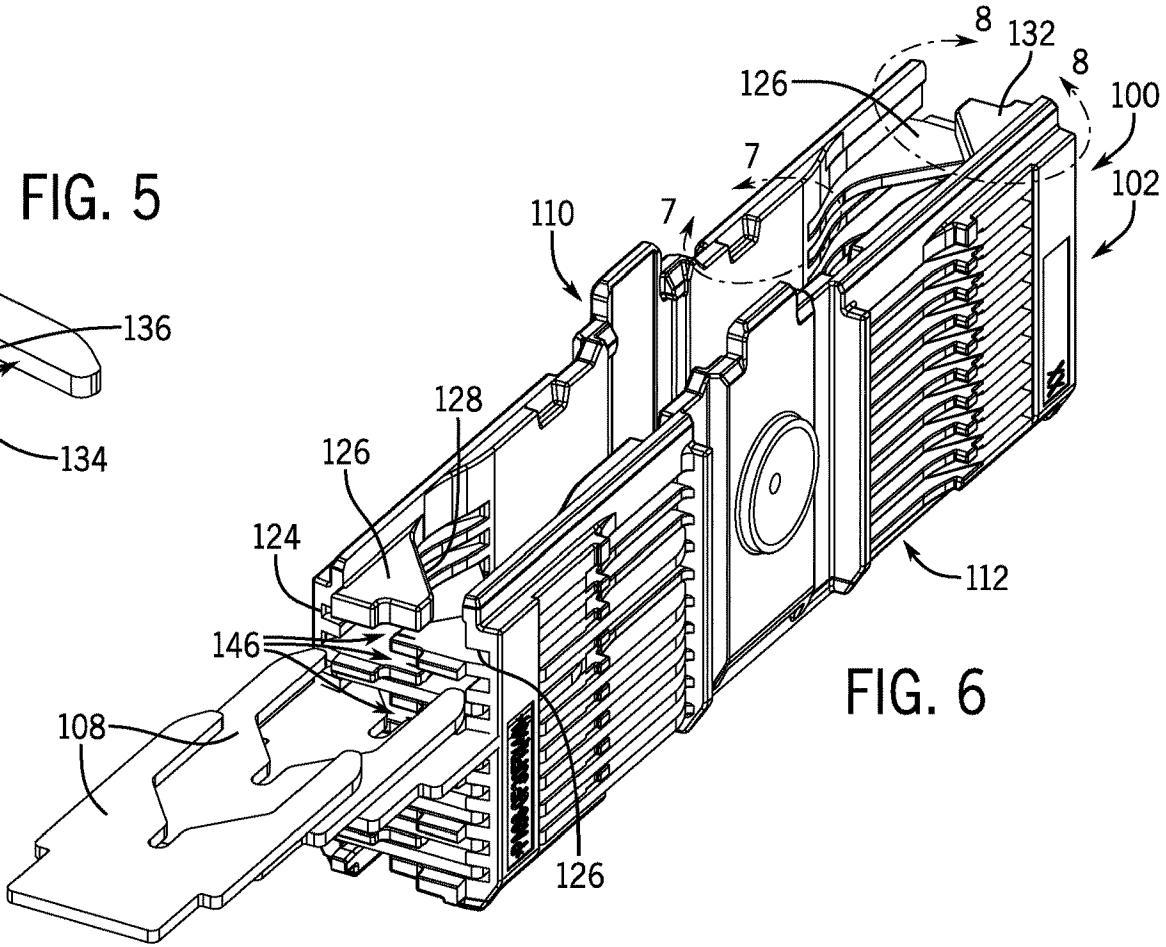
FIG. 6 is a partially exploded view of the arc chamber section of FIG. 2 with the arc chamber framework assembled and illustrating splitter plate insertion.
Figure 7:
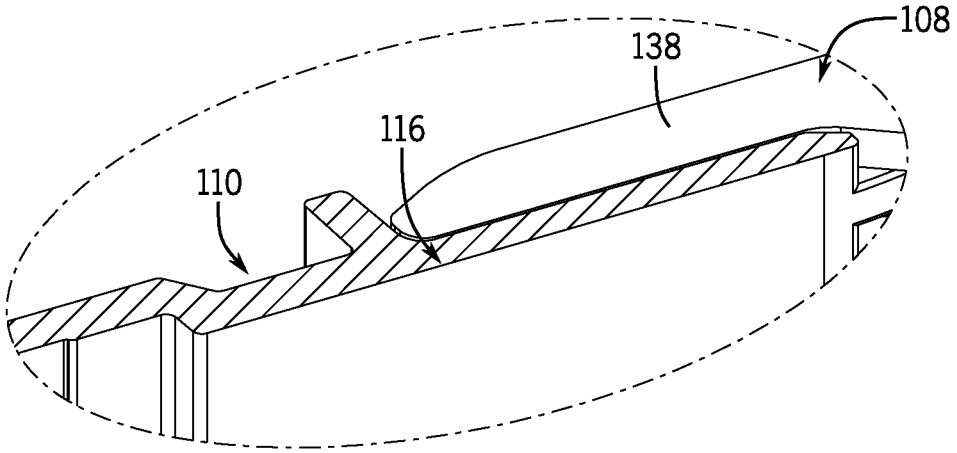
FIG. 7 is a detail view of section 7-7 of FIG. 6 illustrating arms of a splitter plate engaging the arc chamber framework.
Figure 8:
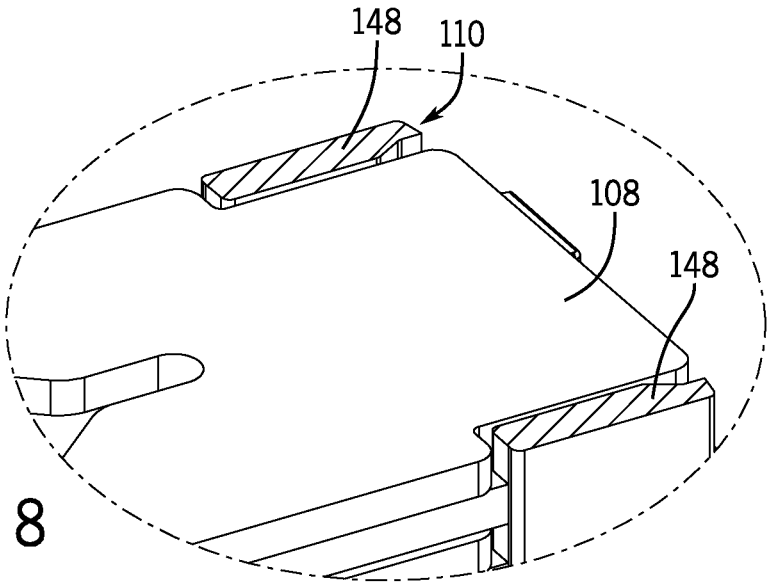
FIG. 8 is a detail view of section 8-8 of FIG. 6 illustrating a splitter plates in the arc chamber framework held by retention notches.

With reference to FIGS. 6-8, when the first panel 110 is assembled to the second panel 112 to form the arc chamber framework 104, each one of the first plurality of slots 124 of the first panel 110 laterally aligns with a corresponding one of the second plurality of slots 130 of the second panel 112. Each pair of laterally aligned slots combine to form an insert slot 146 configured to receive a corresponding one of the splitter plates 108. As each splitter plate 108 is inserted into a corresponding one of the insert slots 146, the corresponding lateral ends of the first panel 110 and the second panel 112 may flex slightly laterally outward to allow the splitter plate 108 to enter the insert slot 146. Upon the complete insertion of a splitter plate 108 within an insert slot 146, the splitter plate 108 may be retained by a splitter plate retainer 148 may be molded into each insert slot 146 (see, e.g., FIG. 8). Additionally, when a splitter plate 108 is completely inserted with an insert slot 146, the splitter plate arms 138 of each splitter plate 108 may provide lateral support to the first panel 110 and the second panel 112, which opposes arc side pressure that generates a laterally outwardly facing biasing force on the first panel and the second panel 112 (see, e.g., FIG. 7).

Figure 9:
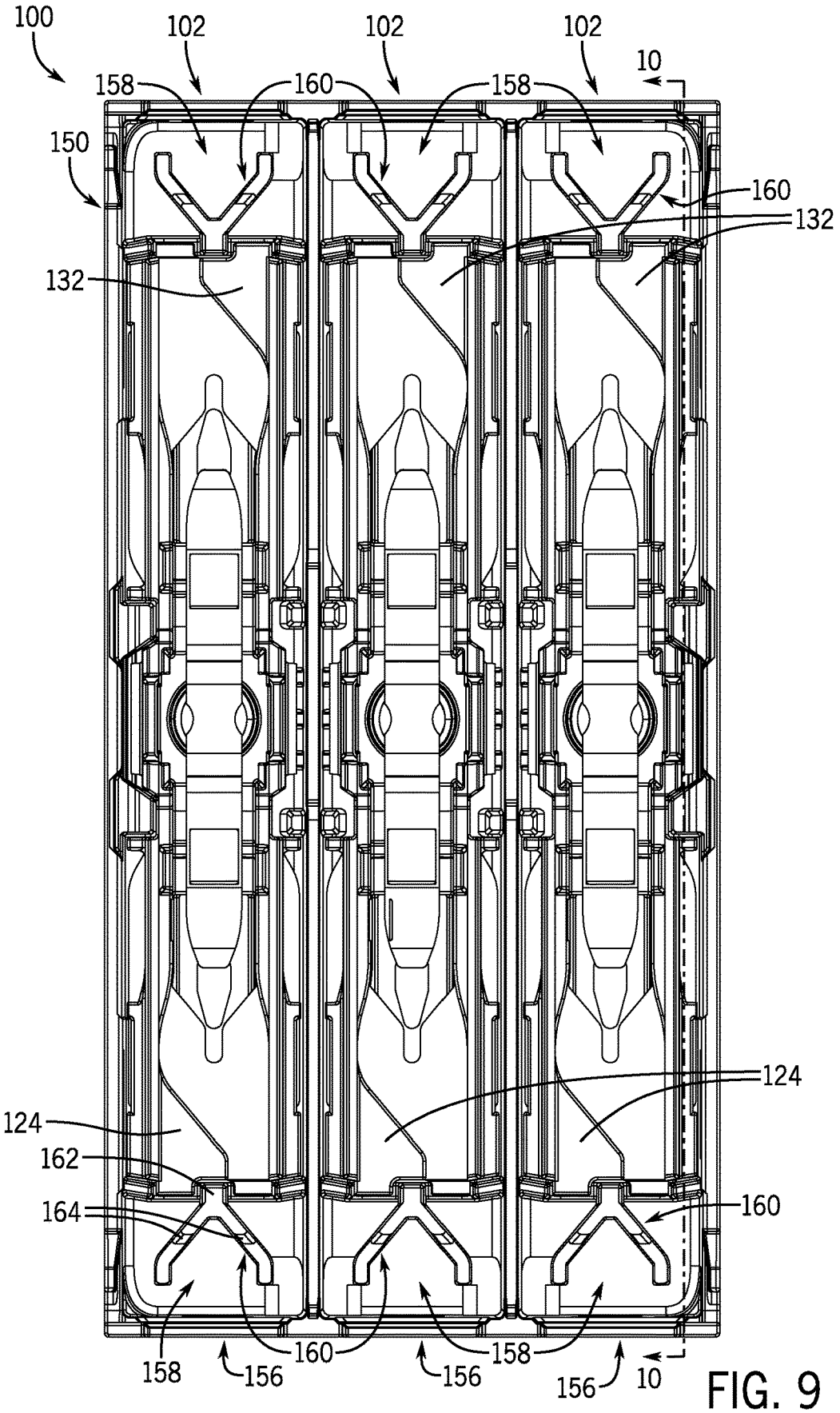
FIG. 9 is a top plan view of the arc chamber assembly of FIG. 1 arranged within a base.
Figure 10:
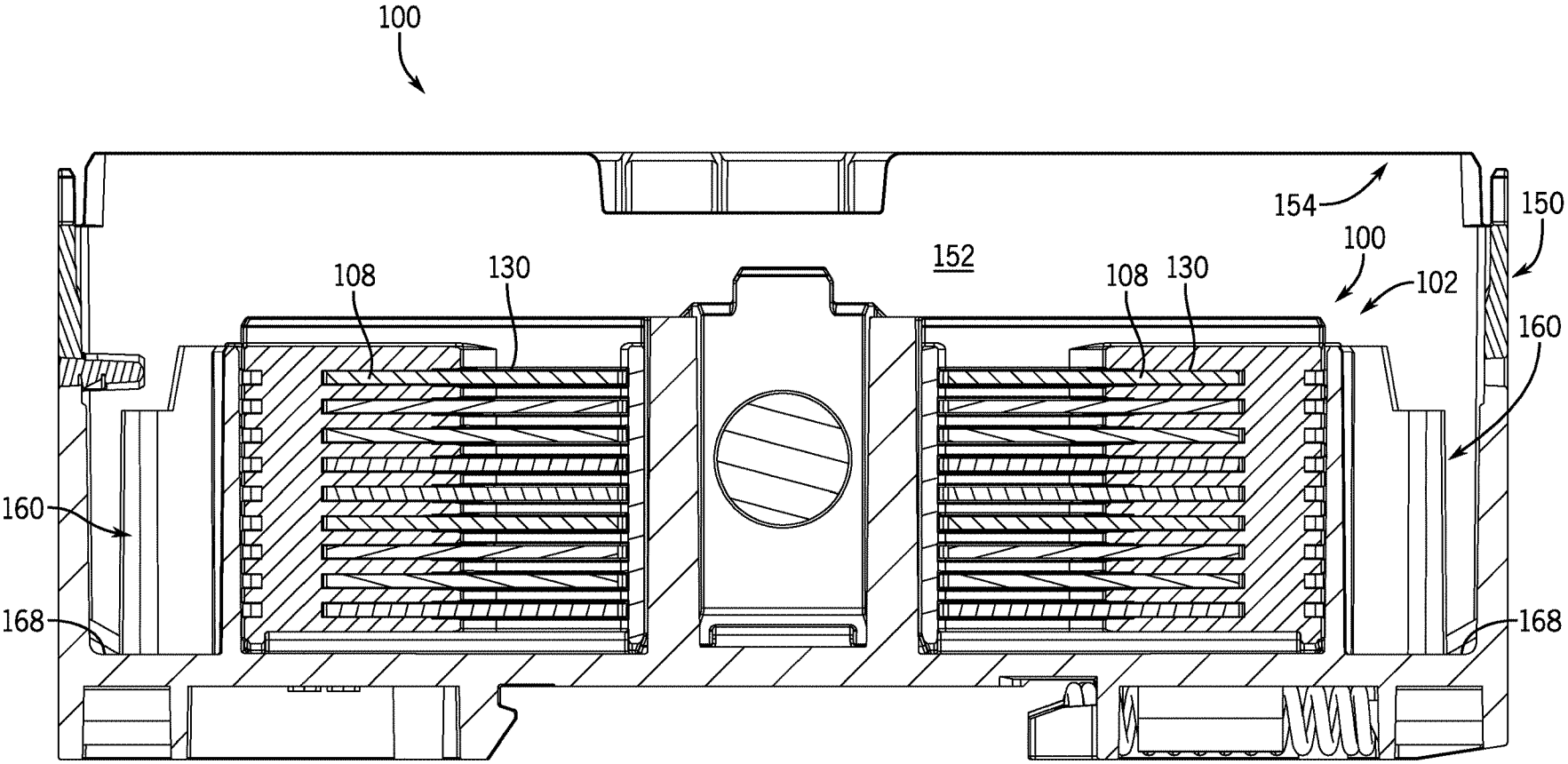
FIG. 10 is a cross-section view of FIG. 9 taken along line 10-10.

FIGS. 9 and 10 illustrated one non-limiting example of the arc chamber assembly 100 installed within a base 150. In some non-limiting examples, the arc chamber assembly 100 and the base 150 may comprise a subassembly for a circuit interrupting device (e.g., a circuit breaker). In the illustrated non-limiting example, the base 150 may define a generally rectangular shape with an internal cavity 152 and a generally open side 154 (e.g., a top side from the perspective of FIG. 10). The arc chamber assembly 100 may be received within the cavity 152, when the subassembly is assembled.

In general, the base 150 may include a number of base sections 156 that corresponds with the number of arc chamber sections 102 in the arc chamber assembly 100. In the illustrated non-limiting example, the base 150 may include three base sections 156, which are each configured to receive a corresponding one of the arc chamber sections 102. The base 150 may define an exhaust chamber 158 arranged adjacent to or downstream of each laterally opposing end of the arc chamber sections 102. In general, each of the exhaust chambers 158 may elongate a distance that arc exhaust needs to travel before being allowed to fully mix and exit the base 150. In this way, for example, the arc exhaust may be allowed to further cool and reduce in pressure, which aids in inhibiting or substantially preventing reignition of the arc. In the illustrated non-limiting example, each exhaust chamber 158 may include a rib 160 arranged adjacent to or downstream of the lateral ends of each of the arc chamber sections 102.

The rib 160 may be generally Y-shaped and may include, for example, a stem 162 and opposing rib arms 164 extending angularly from the stem 162 in a direction away from the arc chamber sections 102. In the illustrated non-limiting example, the stem 162 of each rib 160 may be at least partially received within a notch 166 that is formed between longitudinally-extending protrusions 167 arranged at the longitudinal ends of the first plurality of protrusions 126 and the second plurality of protrusions 132 (see, e.g., FIGS. 10 and 11). In this way, for example, the rib 160 may cooperate with the first plurality of protrusions 126 and the second plurality of protrusions 132 to maintain a separation of arc exhaust initiated by the first plurality of protrusions 126 and the second plurality of protrusions 132.

In the illustrated non-limiting example, the ribs 160 may be integrally formed with the base 150 (i.e., formed as a unitary component). Each of the ribs 160 may extend from an inner surface 168 of the base 150 in a direction toward the open side 154 of the base 150 (e.g., upward from the perspective of FIG. 10). A height (e.g., a vertical height from the perspective of FIG. 10) defined by each of the ribs 160 may generally correspond with a height defined by the arc chamber sections 102. That is, the height that each of the ribs 160 extend from the inner surface 168 may be at least equal to or greater than a height defined by the arc chamber sections 102.

Figure 11:
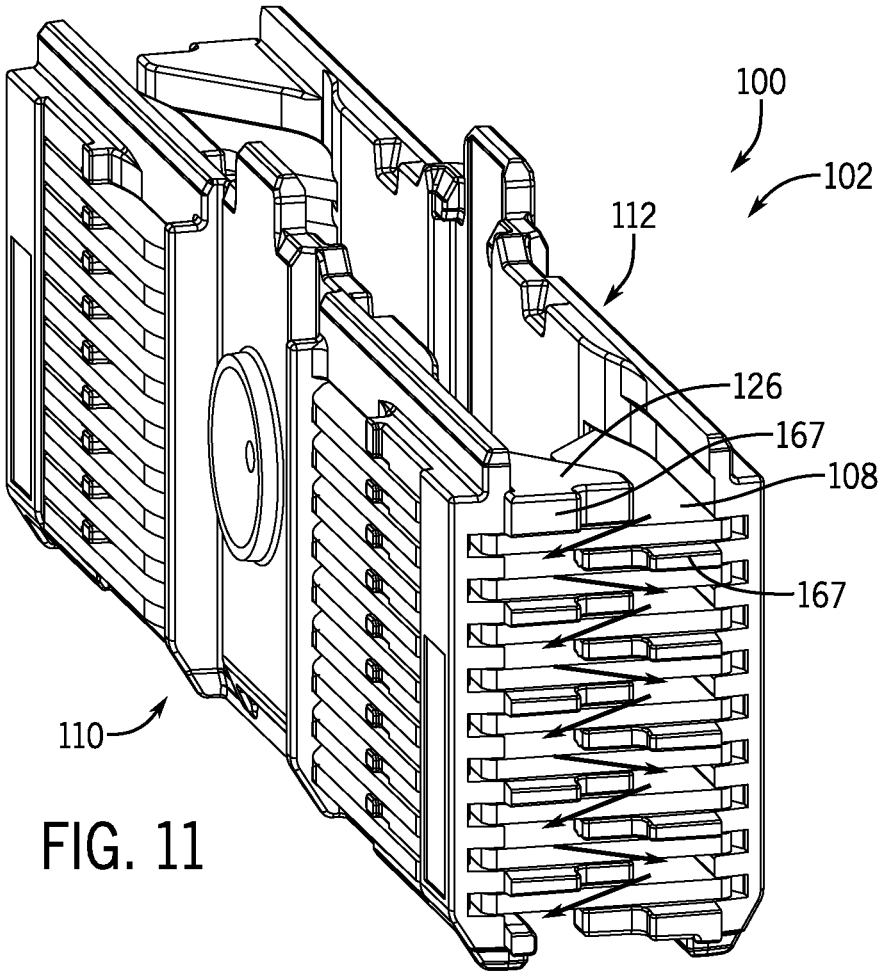
FIG. 11 is a perspective view of arc chamber section of FIG. 2 with the arc chamber section assembled.
Figure 12:
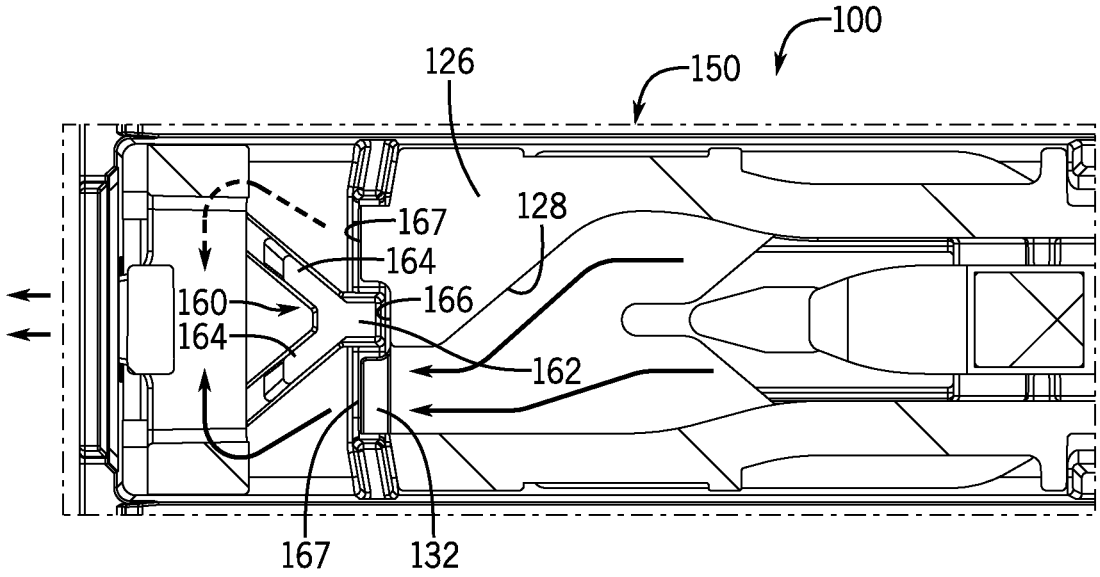
FIG. 12 is a partial top plan view of the assembled arc chamber section of FIG. 11.

Turning to FIGS. 11 and 12, in general, the first plurality of protrusions 126 and the second plurality of protrusions 132 facilitate the redirection and separation of arc exhaust and it flows longitudinally through the arc chamber assembly 100 toward, for example, one or more openings formed in the base 150. When the arc chamber assembly 100 is assembled, each of the first plurality of protrusions 126 may be offset from the second plurality of protrusions 132. In the illustrated non-limiting example, the first plurality of protrusions 126 may be vertically separated (e.g., from the perspective of FIG. 11) from the second plurality of protrusions 132, such that adjacent pairs of the first plurality of protrusions 126 and the second plurality of protrusions 132 are arranged on opposing sides of each of the plurality of splitter plates 108. Since the first plurality of protrusions 126 and the second plurality of protrusions 132 extend in laterally opposing directions, this offset between the first plurality of protrusions 126 and the second plurality of protrusions 132 may redirect or split the arc and/or the arc exhaust into two paths that travel around both of the rib arms 164 of the rib 160 (see, e.g., FIG. 12). In this way, for example, the ability of the arc and/or arc exhaust to mix may be reduced and a distance that the arc and/or arc exhaust needs to travel before being allowed to fully mix and exit the base 150 may be elongated. These characteristics provided by the design of the first plurality of protrusions 126 and the second plurality of protrusions 132, in combination with the rib 160, may inhibit or substantially prevent reignition of an arc generated within the arc chamber assembly 100 prior to exiting the base 150.

Figure 13:
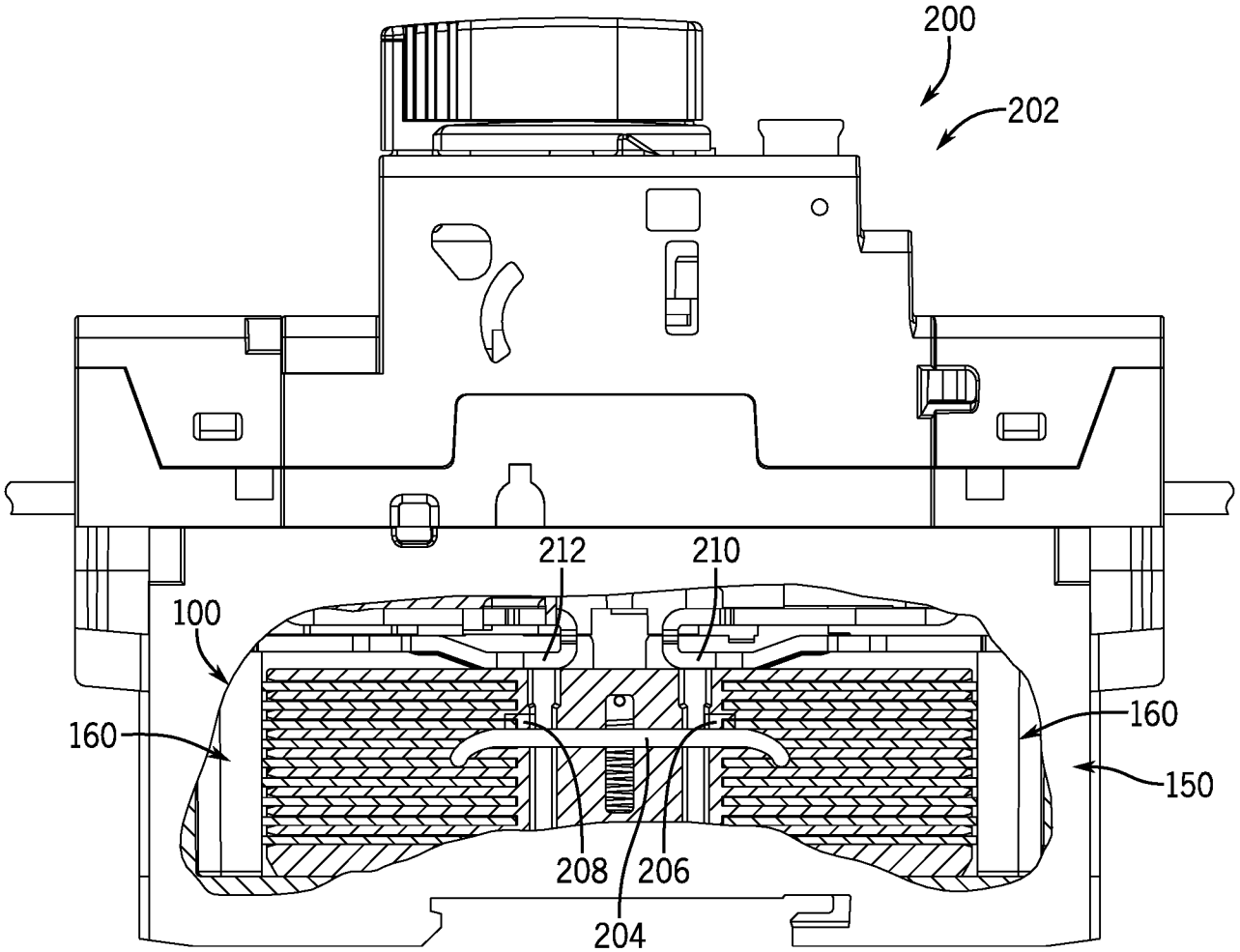
FIG. 13 is a side view with a cutaway of a circuit interrupting device including the arc chamber assembly and base of FIG. 9.
Figure 14:
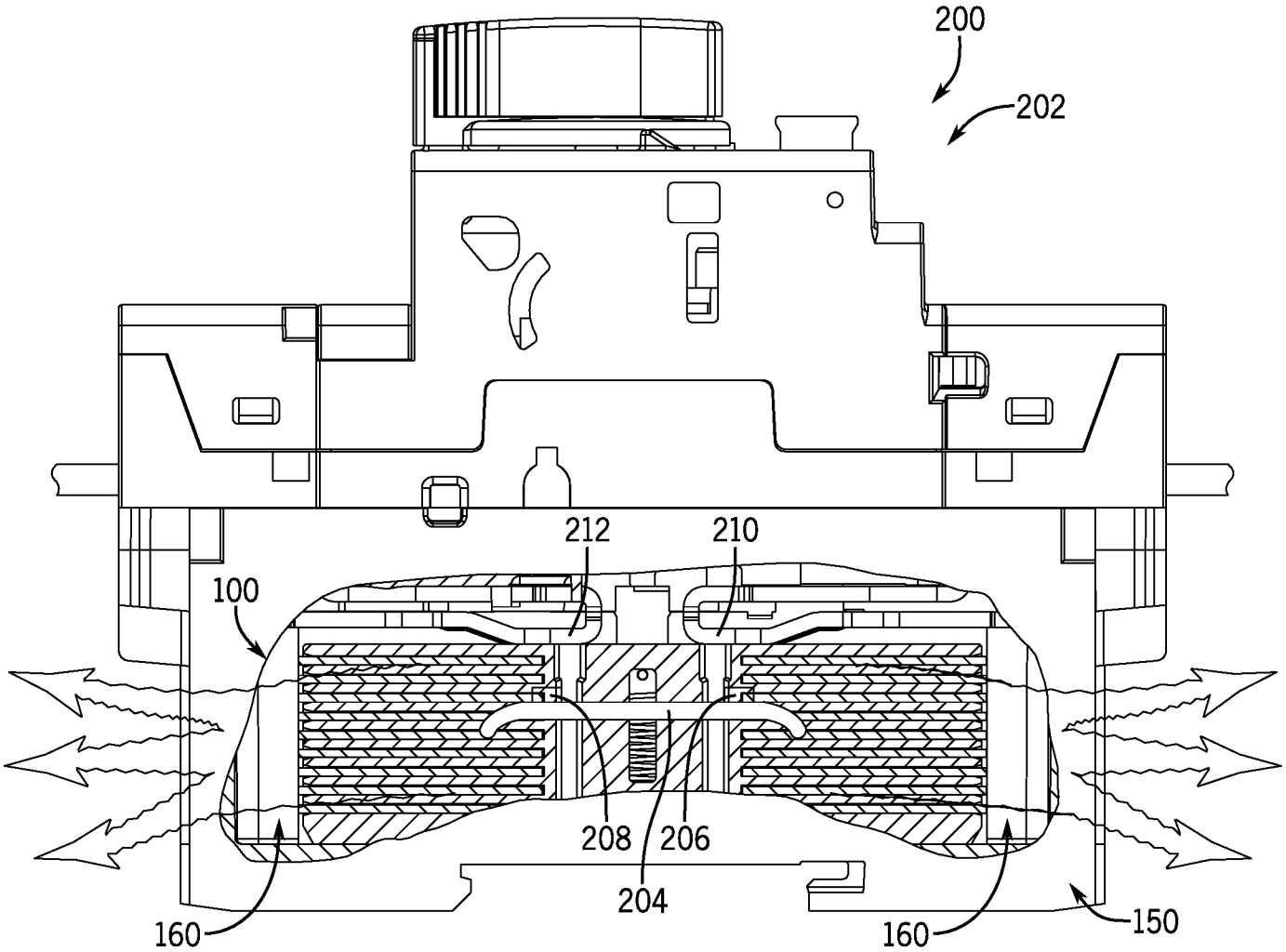
FIG. 14 is a side view with a cutaway of a circuit interrupting device including the arc chamber assembly and base of FIG. 9 and illustrating arc/arc exhaust flow.
Figure 15:
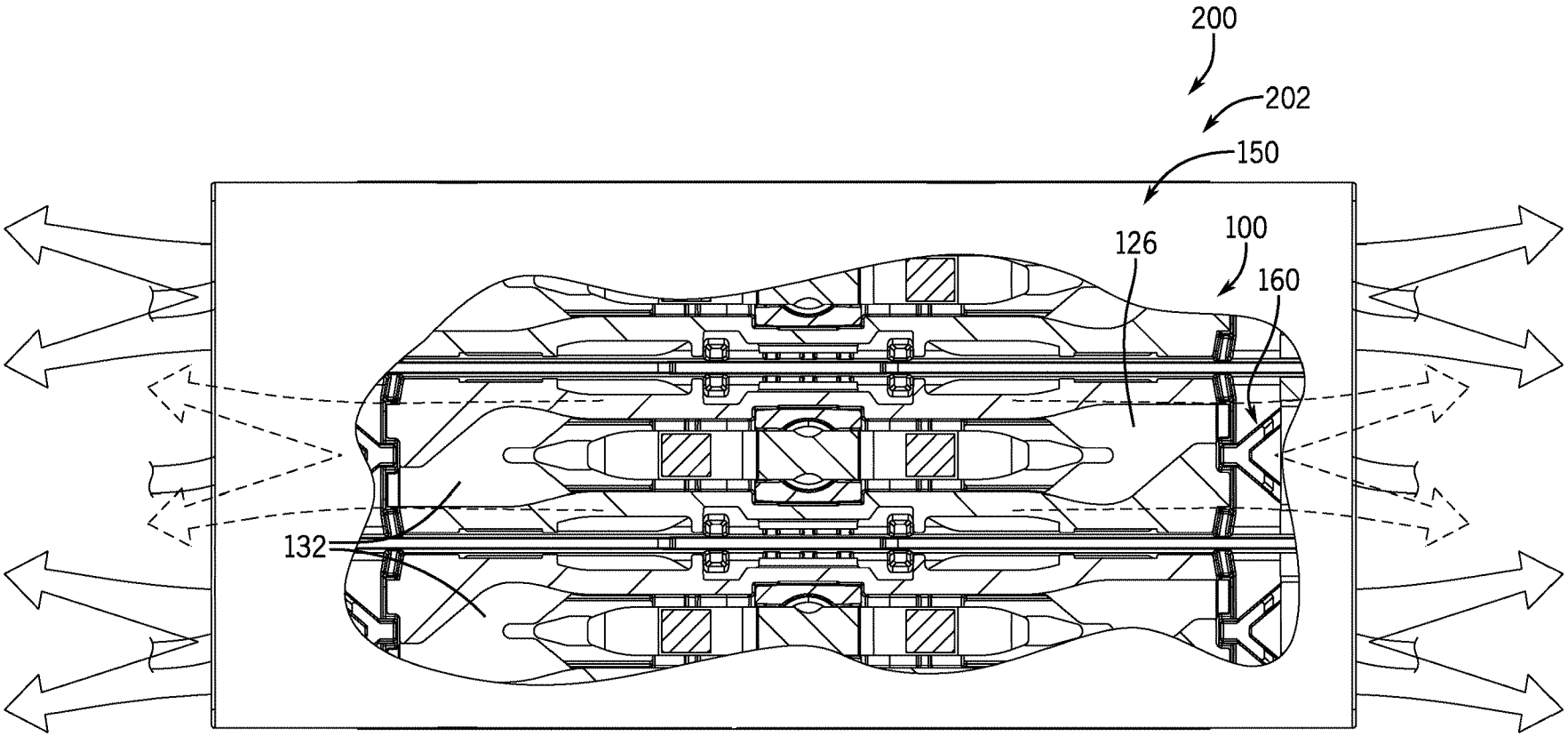
FIG. 15 is a top plan view of the circuit interrupting device of FIG. 14 illustrated arc/arc exhaust flow.

FIGS. 13-15 illustrated one non-limiting example of the subassembly including the arc chamber assembly 100 and the based 150 installed within a circuit interrupting device 200 in the form of a circuit breaker 202. In general, the components and functionality of the circuit breaker 202, except the arc chamber assembly 100 and the base 150 may be similar to the circuit interrupting device disclosed in U.S. Pat. No. 10,056,210, which is owned by the Applicant and hereby incorporated by reference in its entirety.

In general, the circuit breaker 202 may include a movable contact arm 204 for each phase of electric power that may be moved, such that a power movable contact 206 and a load movable contact 208 may move relative to a power stationary contact 210 and a load stationary contact 212. During operation, the movable contact arm 204 may be moved from an energized state and a de-energized state. In the energized state, the power movable contact 206 and the load movable contact 208 contact that power stationary contact 210 and the load stationary contact 212, respectively, thereby forming an electric circuit with electric current flowing through the moveable contact arm 204. When the movable contact arm 204 is moved to a de-energized state, interruption of the electric current flow may generate an electric arc. The generation of an electric arc may results in a rapid increase in temperature and pressure internal to each of the arc chamber sections 102.

As described herein, the design and properties of the arc chamber assembly 100 and the base 150 may aid in quenching and inhibiting or substantially preventing reignition of the arc. In general, the design of the arc chamber assembly 100 may restrict gas produced as a result of the arc to the interior of the arc chamber assembly 100, and may only allow the arc exhaust to exit the circuit breaker 202 through the base 150 (e.g., via one or more openings formed therein).

Each of the plurality of splitter plates 108, as part of the splitter plate groups 106, attracts the electromagnetic portion of the arc and splits the arc in order to quickly raise the arc voltage, which results in the arc being extinguished more quickly when compared to the arc not being split. As the arc and/or arc exhaust travels along each of plurality of splitter plates 108, the arc and/or arc exhaust on one side of the splitter plate 108 may be redirected toward one of the rib arms 164 by one of the first plurality of protrusions 126 and arc and/or arc exhaust one an opposing side of the splitter plate 108 may be redirected toward the other of the rib arms 164 by one of the second plurality of protrusions 132. Once the arc and/or arc exhaust is redirected by the first plurality of protrusions 126 and the second plurality of protrusions 132, the arc and/or arc exhaust is split into two paths and forced to travel around both of the rib arms 164 prior to exiting the base 150, for example, through one or more openings formed therein. The redirection, separation, and elongation of the flow path of the arc and/or arc exhaust aid in quenching the arc and inhibiting or substantially preventing the arc exhaust from reigniting.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

We claim:

1. A circuit interrupting device comprising:

a base; and an arc chamber assembly received within the base and including an arc chamber framework and a plurality of splitter plates received within the arc chamber framework, wherein the arc chamber framework includes a first plurality of protrusions and a second plurality of protrusions that laterally extend in a direction toward one another, and wherein adjacent pairs of the first plurality of protrusions and the second plurality of protrusions are arranged on opposing sides of each of the plurality of splitter plates, wherein the first plurality of protrusions extend from a first panel and the second plurality of protrusions extend from a second panel, and wherein each of the first plurality of protrusions and the second plurality of protrusions includes an angled surface arranged internally between the first panel and the second panel, and wherein the angled surfaces of the first plurality of protrusions angle toward the second panel and the angled surfaces of the second plurality of protrusions angle toward the first panel.

2. A circuit interrupting device comprising:

a base; and an arc chamber assembly received within the base and including an arc chamber framework and a plurality of splitter plates received within the arc chamber framework, wherein the arc chamber framework includes a first plurality of protrusions and a second plurality of protrusions that laterally extend in a direction toward one another, and wherein adjacent pairs of the first plurality of protrusions and the second plurality of protrusions are arranged on opposing sides of each of the plurality of splitter plates, wherein the base includes a rib arranged adjacent to the first plurality of protrusions and the second plurality of protrusions.

3. The circuit interrupting device of claim 2, wherein the rib is integrally formed with the base.

4. The circuit interrupting device of claim 2, wherein the rib is Y-shaped.

5. The circuit interrupting device of claim 2, wherein the rib includes a pair of rib arms that extend from a stem in opposing directions.

6. The circuit interrupting device of claim 2, wherein the first plurality of protrusions, the second plurality of protrusions, and the rib define flow paths that extend around opposing sides of the rib.

7. A circuit interrupting device comprising:

a base including an open end and defining an internal cavity having an inner surface;

a rib extending from the inner surface in a direction toward the open end and including a pair of opposing rib arms; and an arc chamber assembly received within the internal cavity and including a first panel, a second panel, and a plurality of splitter plates received within first panel and the second panel, wherein the first panel includes a first plurality of protrusions extending laterally toward the second panel, and the second panel includes a second plurality of protrusions extending laterally toward the first panel, and wherein the first plurality of protrusions are offset from the second plurality of protrusions to form two flow paths that extend along the plurality of splitter plates and around the pair of opposing rib arms.

8. The circuit interrupting device of claim 7, wherein each of the first plurality of protrusions and the second plurality of protrusions are triangularly shaped.

9. The circuit interrupting device of claim 7, wherein the first plurality of protrusions and the second plurality of protrusions each include a tapered portion that increases in lateral width as the tapered portion extends in a direction toward a longitudinal end of the arc chamber assembly.

10. The circuit interrupting device of claim 7, wherein adjacent pairs of the first plurality of protrusions and the second plurality of protrusions are arranged on opposing sides of each of the plurality of splitter plates.

11. The circuit interrupting device of claim 7, wherein the rib is integrally formed with the inner surface of the base.

12. The circuit interrupting device of claim 7, wherein the rib is Y-shaped.

13. The circuit interrupting device of claim 7, wherein the rib includes a stem that is at least partially received within a notch formed between the first plurality of protrusions and the second plurality of protrusions.

14. A circuit interrupting device comprising:

a base;

a rib integrally formed with the base; and an arc chamber assembly received within the base, wherein the arc chamber assembly includes an arc chamber framework defining a plurality of insert slots each receiving a splitter plate therein and a plurality of protrusions extending in laterally opposing directions and offset from one another, and wherein the rib is at least partially received within a notch formed between the plurality of protrusions such that flow paths are formed on opposing sides of the rib.

15. The circuit interrupting device of claim 14, wherein the plurality of protrusions includes a first plurality of protrusions and a second plurality of protrusions offset from the first plurality of protrusions.

16. The circuit interrupting device of claim 15, wherein adjacent pairs of the first plurality of protrusions and the second plurality of protrusions are arranged on opposing sides of each of the splitter plates.

17. The circuit interrupting device of claim 14, wherein the plurality of protrusions each include a tapered portion that increases in lateral width as the tapered portion extends in a direction toward a longitudinal end of the arc chamber framework.

18. The circuit interrupting device of claim 14, wherein the rib includes a pair of rib arms that extend from a stem in opposing directions.

19. The circuit interrupting device of claim 18, the stem is at least partially received within a notch formed between the plurality of protrusions.

* * * * *